United States Patent [19]

Hollenbeck

[11] 4,187,772

[45] Feb. 12, 1980

[54] HAND OPERATED FLEXIBLE STAMP CARRIER

[76] Inventor: Paul R. Hollenbeck, Star Rte. Box 98, Eastsound, Wash. 98245

[21] Appl. No.: 890,959

[22] Filed: Mar. 28, 1978

[51] Int. Cl.[2] ..... B41K 1/04; B41K 1/28

[52] U.S. Cl. ..... 101/379; 101/109; 101/406

[58] Field of Search ..... 101/379, 376, 109, 103, 101/368, 406

[56] References Cited

U.S. PATENT DOCUMENTS

| | | | |
|---|---|---|---|
| 1,606,190 | 11/1926 | Sharp | 101/376 |
| 1,611,679 | 12/1926 | Rees | 101/376 X |
| 3,109,368 | 11/1963 | Luttrell | 101/379 X |
| 3,180,260 | 4/1965 | Joseph | 101/379 X |
| 3,309,987 | 3/1967 | Pexton | 101/379 X |
| 3,779,159 | 12/1973 | Rose et al. | 101/376 X |

*Primary Examiner*—Clifford D. Crowder

*Attorney, Agent, or Firm*—James D. Givnan, Jr.

[57] ABSTRACT

A stamp carrier on which a plurality of elastomeric stamps are mounted for the marking of lumber and other products. In a stamping operation, an appendage of the carrier flexes to assure desired presentation of the stamp to the surface. The carrier is of molded construction and utilizes resilient materials of different hardness to avoid distortion of the stamp when the latter is applied other than in a true manner to the product.

1 Claim, 3 Drawing Figures

HAND OPERATED FLEXIBLE STAMP CARRIER

BACKGROUND OF THE INVENTION

The present invention relates generally to stamping devices for applying markings to various manufactured products.

In the lumber industry it is customary to apply indicia or markings to denote the grade of lumber. This is normally accomplished by a lumber grader equipped with a manually held stamping device on which a relieved stamp plate (or plates) is mounted. One example of such a stamp is found in U.S. Pat. No. 1,793,224.

A problem has existed for many years in the varying legibility of markings applied to lumber. For the most part, illegible marks are attributable to the stamp not being brought into uniform contact with the product surface in a true manner, i.e., other than in full surfacial contact. Further, lumber is sometimes stacked at inconvenient heights which hinders the marking of same. Illegible marking can result in considerable inconvenience.

SUMMARY OF THE PRESENT INVENTION

The present invention is embodied within a unitary stamp carrier of molded construction on which are surfaces each for mounting a stamp in a yieldable manner to assure suitable contact with the marked surface.

The present stamp carrier is of cruciform configuration having appendages terminating in stamp mounting members each having a flat surface to which the stamp is affixed. A central body portion of the carrier is adapted to receive a handle or other instrumentality for imparting motion to the carrier. The appendages are of a flexible nature with reduced sectional areas to promote universal flexibility. The extremities of the appendages carry stamp mounting members and are of material of greater rigidity than the appendages so as to inhibit severe stamp distortion when angularly presented to the surface marked.

A support for the carrier is shown as a handle having a transverse pin embedded within the carrier.

The present stamp carrier provides several stamp mounting surfaces each supported by a highly flexible appendage which permits the stamp on each surface to come into surfacial contact with the stamped surface regardless of stamp presentation being other than in a true, perpendicular manner. The stamp carrier is of lightweight molded construction and hence low unit manufacturing cost avoids costly assembly effort as well as loss of parts during customary vigorous use. The carrier appendages and stamp bearing members are of different resiliency for purposes of making precise, legible markings on the stamped article.

DETAILED DESCRIPTION OF THE PREFERRED EMBODIMENT

Figure 1:
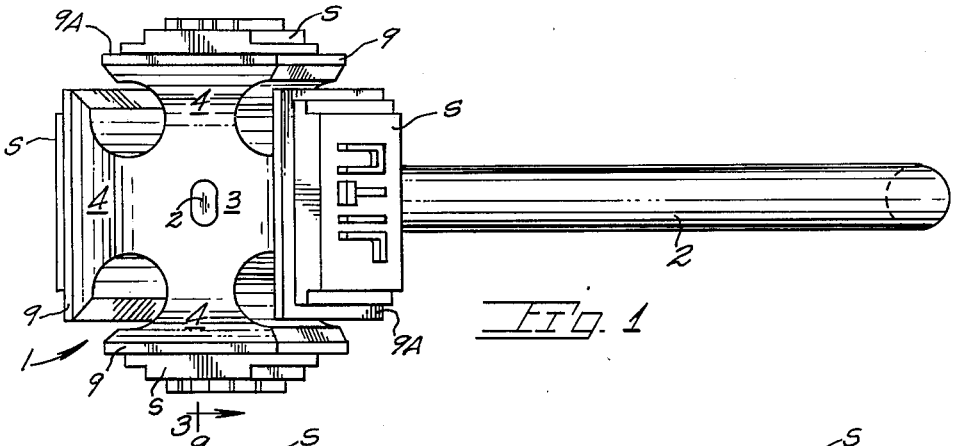
FIG. 1 is a perspective view of the present stamp carrier.

With continuing attention to the drawing, the reference numeral 1 indicates generally the stamp carrier which is of cruciform shape. A support member for the carrier is shown as a handle 2 but may of course be otherwise embodied in other means for moving the stamp carrier. The handle shown may include a socket at its free end to receive an extension rod to facilitate article marking at awkward heights.

The carrier embodying the present invention includes a central body portion 3 within which a handle receiving opening 3A is formed. Integral with said central body portion are appendages 4 each of which has front and rear walls 5 and 6 and sidewalls 7. The appendages have at their outer ends stamp support members 9 shown as being polygonal having outer surfaces 9A on which a stamp S is mounted as by a suitable adhesive or bonding agent. Each appendage has a major axis at A.

The stamp support members 9 are integral with the outer ends of their respective appendages and in similarity to the supporting appendage are of a resilient material such as a thermosetting, castable polyurethane. In the molding of the carrier, different hardeners are utilized to achieve one hardness for the support members 9 and a different hardness for appendages 4. For example, the support member in one form of the invention is found to be entirely satisfactory when formed with a durometer reading of 70 on a D scale while appendage is entirely satisfactory when formed with a durometer reading of 60 on an A scale per ASTM specifications. Accordingly appendage 4 yieldably supports the more rigid stamp bearing member 9 with the appendage initially flexing to compensate for an out of parallel presentation of the stamp to the surface being marked. Such flexing assures, in virtually all stamping operations, that the stamp will be properly applied resulting in a fully legible marking to the article. Heretofore, an improperly presented stamp resulting in only a portion of the desired marking being applied to the surface which necessitated a repeated stamping.

Figure 2:
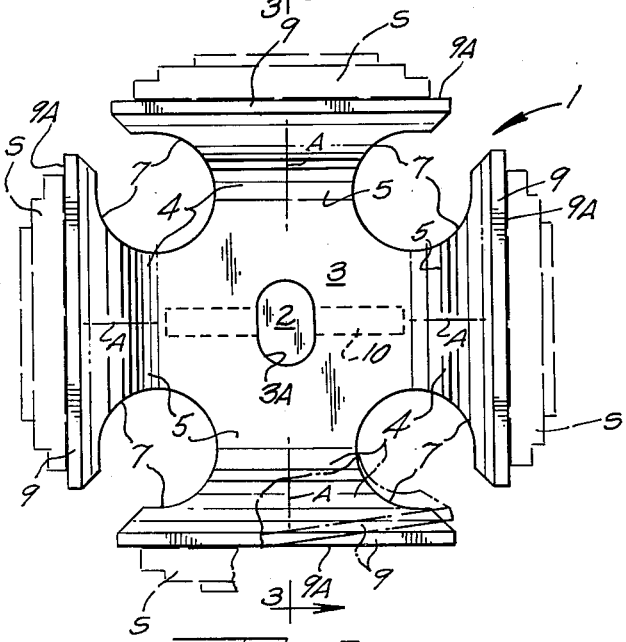
FIG. 2 is a front elevational view thereof.
Figure 3:
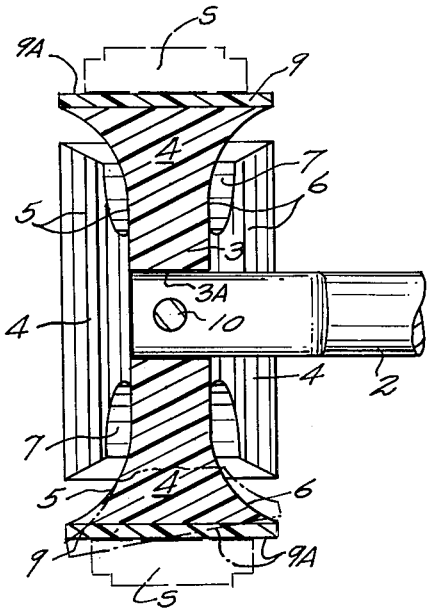
FIG. 3 is a vertical sectional view taken along line 3—3 of FIG. 2.

In FIGS. 2 and 3, the carrier is shown at approximately three quarter scale with the central body portion, in that form of the invention shown, having a thickness of approximately 19mm. The appendages are characterized by inwardly converging walls of nonconstant transverse section which merge at a reduced appendage section with the central body portion. Stated otherwise, the appendages are characterized by an inwardly decreasing sectional dimension to contribute toward desired flexibility.

The handle is secured by a pin 10 extending transversely into the carrier.

While I have shown but one embodiment of the invention it will be apparent to those skilled in the art that the invention may be embodied still otherwise without departing from the spirit and scope of the invention.

Having thus described the invention, what is claimed and desired to be secured under a Letters Patent is:

1. A hand operated stamp carrier on which a plurality of flexible stamps are resiliently supported, said stamp carrier comprising, a handle, a central body portion affixed to one end of said handle, yieldable appendages molded integral with and projecting outwardly from said central body portion, yieldable stamp support members molded integral with the distal ends of said appendages but having a greater hardness rating than that rating of said appendages, said central body portion, appendages and stamp support member being of unitary molded construction, said appendages each having front, rear and sidewalls all converging in an inward direction to provide appendages of substantially reduced section at mergence with the central body portion to render the appendages highly yieldable in the presence of asymetrical forces acting on said stamp support members to prevent distortion of a flexible stamp therein.

* * * * *